US010411412B2

(12) United States Patent
Chu

(10) Patent No.: US 10,411,412 B2
(45) Date of Patent: Sep. 10, 2019

(54) ELECTRICAL RECEPTACLE CONNECTOR WITH AN ENHANCED STRUCTURAL STRENGTH OF A TONGUE

(71) Applicant: VITECK CO., LTD., Taoyuan (TW)

(72) Inventor: Yu-Ching Chu, Taoyuan (TW)

(73) Assignee: VITECK CO., LTD., Taoyuan (TW)

( * ) Notice: Subject to any disclaimer, the term of this patent is extended or adjusted under 35 U.S.C. 154(b) by 0 days.

(21) Appl. No.: 16/041,840

(22) Filed: Jul. 23, 2018

(65) Prior Publication Data

US 2019/0036276 A1 Jan. 31, 2019

(30) Foreign Application Priority Data

Jul. 31, 2017 (TW) ..... 106211215 U

(51) Int. Cl.

| | |
|---|---|
| ***H01R 13/6581*** | (2011.01) |
| ***H01R 13/6594*** | (2011.01) |
| *H01R 24/60* | (2011.01) |
| *H01R 107/00* | (2006.01) |
| *H01R 12/71* | (2011.01) |

(52) U.S. Cl.

CPC ..... *H01R 13/6581* (2013.01); *H01R 13/6594* (2013.01); *H01R 12/716* (2013.01); *H01R 24/60* (2013.01); *H01R 2107/00* (2013.01)

(58) Field of Classification Search

CPC ..... H01R 13/6581; H01R 13/6594; H01R 24/60; H01R 12/716; H01R 2107/00

USPC ..... 439/660, 607.01, 607.05

See application file for complete search history.

(56) References Cited

U.S. PATENT DOCUMENTS

| | | | | |
|---|---|---|---|---|
| 9,979,102 | B2 * | 5/2018 | Zhao | H01R 9/032 |
| 10,020,619 | B2 * | 7/2018 | Zhang | H01R 12/7082 |
| 2016/0197443 | A1 * | 7/2016 | Zhang | H01R 13/6585 439/607.05 |

FOREIGN PATENT DOCUMENTS

WO WO-2015181630 A2 * 12/2015 ..... H01R 12/7082

* cited by examiner

*Primary Examiner* — Tulsidas C Patel
*Assistant Examiner* — Travis S Chambers
(74) *Attorney, Agent, or Firm* — Winston Hsu

(57) ABSTRACT

An electrical receptacle connector includes an insulator, a first contact set, a second contact set, a U-shaped shielding structure, and a first plate member. The insulator includes a tongue and a base connected to the tongue. The first contact set and the second contact set are disposed inside the insulator and exposed out of a first side and a second side of the tongue opposite to each other. The U-shaped shielding structure is disposed on the base and at least partially exposed out of the base. The first plate member extends from an end portion of the U-shaped shielding structure along a third side adjacent to the first side and the second side of the tongue and toward a front end of the tongue. The first plate member includes a first step structure. Therefore, it effectively prevents the tongue from being worn or deformed by insertion and withdrawal forces.

9 Claims, 7 Drawing Sheets

ELECTRICAL RECEPTACLE CONNECTOR WITH AN ENHANCED STRUCTURAL STRENGTH OF A TONGUE

BACKGROUND OF THE INVENTION

1. Field of the Invention

The present invention relates to an electrical receptacle connector, and more particularly, to an electrical receptacle connector capable of preventing damage or deformation of a tongue.

2. Description of the Prior Art

An electrical connector is an inevitable component of an electronic device for battery charge or signal transmission of the electronic device. However, with frequent insertion and withdrawal of the electrical connector, a tongue of the electrical connector may be worn out to be damaged or even to be broken easily. An electrical receptacle connector is usually built into a main board of an electronic device. Therefore, if a tongue of the electrical receptacle connector is damaged or broken, it is required to repair or replace the main board of the electronic device, which leads to high maintenance cost.

SUMMARY OF THE INVENTION

Therefore, it is an objective of the present invention to provide an electrical receptacle connector capable of preventing damage or deformation of a tongue to enhance structural strength of the electrical receptacle connector for solving the aforementioned problems.

In order to achieve the aforementioned objective, the present invention discloses an electrical receptacle connector including an insulator, a first contact set, a second contact set, a U-shaped shielding structure, a first plate member and a second plate member. The insulator includes a tongue and a base connected to the tongue. The first contact set is disposed inside the insulator and exposed out of a first side of the tongue. The second contact set is disposed inside the insulator and exposed out of a second side of the tongue opposite to the first side of the tongue. The U-shaped shielding structure is disposed on the base and at least partially exposed out of the base. The first plate member extends from an end portion of the U-shaped shielding structure along a third side of the tongue adjacent to the first side and the second side of the tongue and toward a front end of the tongue, and the first plate member includes a first step structure. The second plate member extends from another end portion of the U-shaped shielding structure away from the end portion of the U-shaped shielding structure along a fourth side of the tongue opposite to the third side of the tongue and toward the front end of the tongue, and the second plate member includes a second step structure. An end of the first plate member adjacent to the front end of the tongue is separated from an end of the second plate member adjacent to the front end of the tongue.

According to an embodiment of the present invention, the first plate member further includes a first inclined structure extending from an end of the first step structure away from the U-shaped shielding structure and toward the front end of the tongue.

According to an embodiment of the present invention, the first plate member further includes a first extending structure extending from an end of the first inclined structure away from the first step structure along the front end of the tongue and toward the fourth side of the tongue opposite to the third side of the tongue.

According to an embodiment of the present invention, the first plate member further includes a first bending structure extending from an end of the first extending structure away from the first inclined structure and toward an inner side of the tongue.

According to an embodiment of the present invention, the second plate member further includes a second inclined structure extending from an end of the second step structure away from the U-shaped shielding structure and toward the front end of the tongue.

According to an embodiment of the present invention, the second plate member further includes a second extending structure extending from an end of the second inclined structure away from the second step structure along the front end of the tongue and toward the third side of the tongue.

According to an embodiment of the present invention, the second plate member further includes a second bending structure extending from an end of the second extending structure away from the second inclined structure and toward an inner side of the tongue.

According to an embodiment of the present invention, the U-shaped shielding structure includes a first member, a second member and a third member. The first member and the second member are opposite to each other. The third member is connected to a first end of the first member and a third end of the second member. A second end of the first member away from the first end of the first member is separated from a fourth end of the second member away from the third end of the second member. The first plate member extends from the first member of the U-shaped shielding structure along the third side of the tongue and toward the front end of the tongue, and the second plate member extends from the second member of the U-shaped shielding structure along the fourth side of the tongue and toward the front end of the tongue.

According to an embodiment of the present invention, the U-shaped shielding structure includes a first member, a second member and a third member. The first member and the second member are opposite to each other. The third member includes a first segment and a second segment separated from the first segment. The first segment is connected to a first end of the first member. The second segment is connected to a third end of the second member. A second end of the first member away from the first end of the first member is separated from a fourth end of the second member away from the third end of the second member. The first plate member extends from the first member of the U-shaped shielding structure along the third side of the tongue and toward the front end of the tongue, and the second plate member extends from the second member of the U-shaped shielding structure along the fourth side of the tongue and toward the front end of the tongue.

In summary, the present invention utilizes the first plate member and the second plate member extending from the U-shaped shielding structure for reinforcing overall structural strength of the tongue, which prevents damage or deformation of the tongue during frequent insertion and withdrawal of the electrical connector. Therefore, the electrical connector has a longer service life to reduce maintenance cost.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
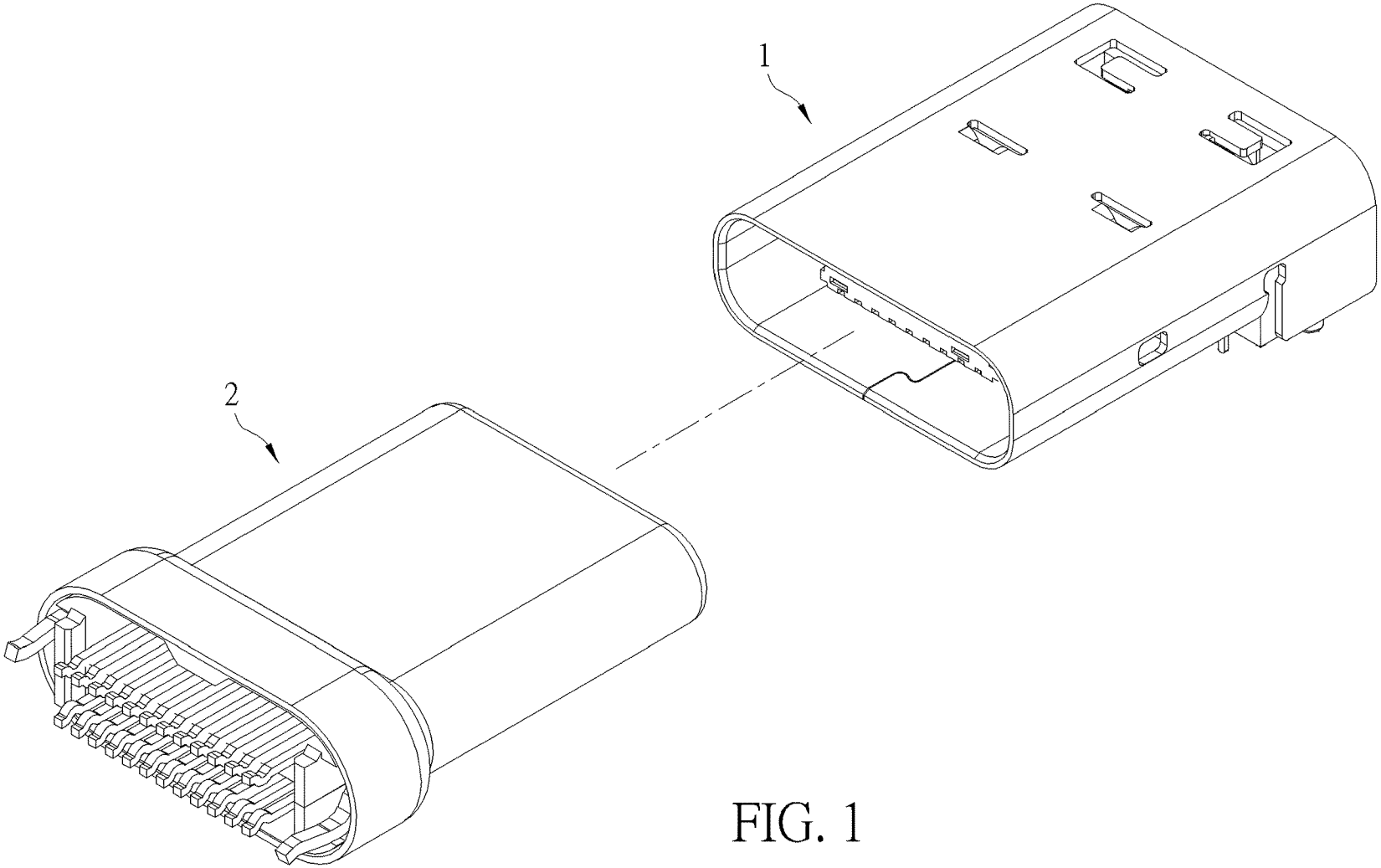
FIG. 1 is a schematic diagram of an electrical receptacle connector and a corresponding electrical plug connector according to a first embodiment of the present invention.
Figure 2:
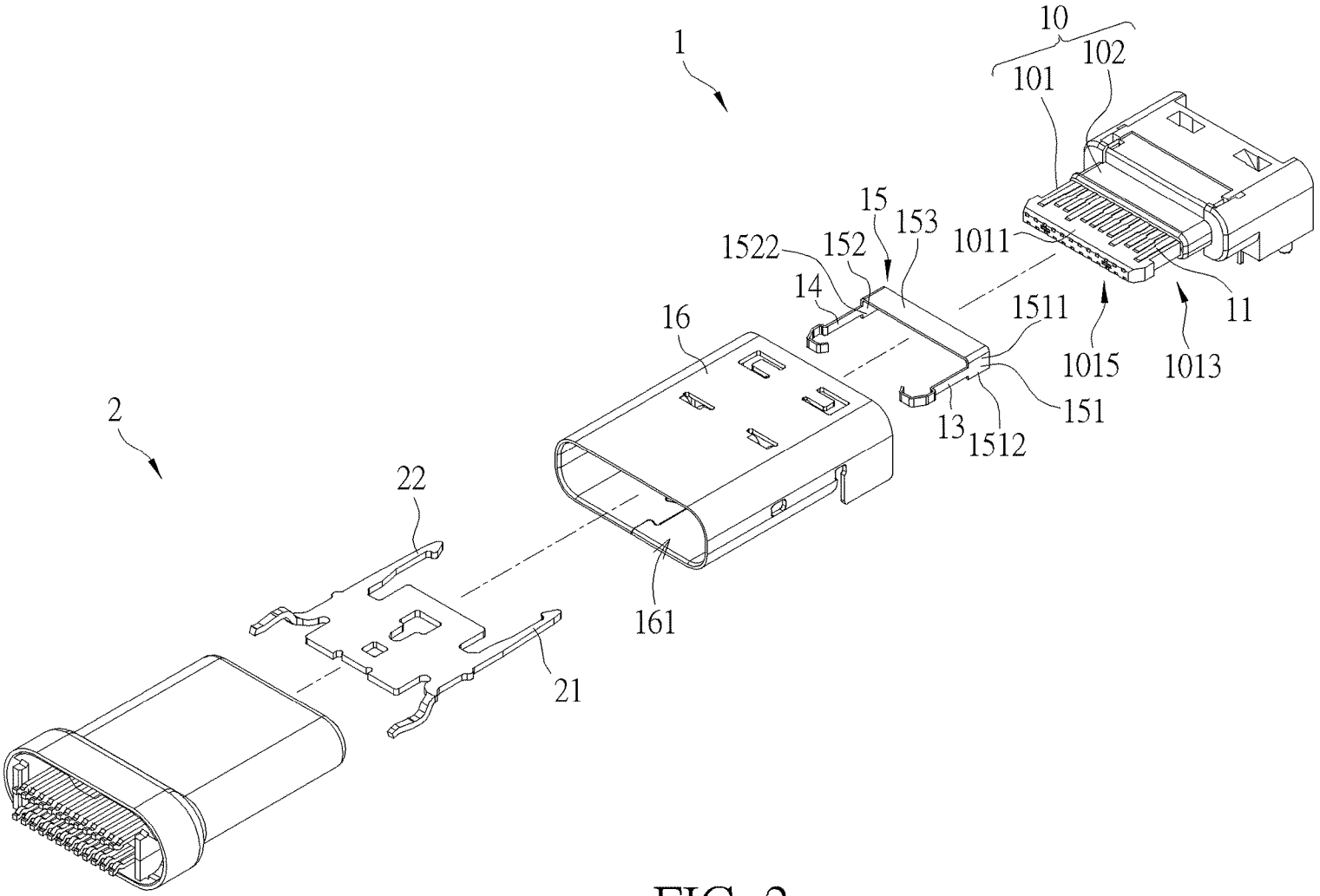
FIG. 2 and FIG. 3 are exploded diagrams of the electrical receptacle connector and the corresponding electrical plug connector at different views according to the first embodiment of the present invention.
Figure 3:
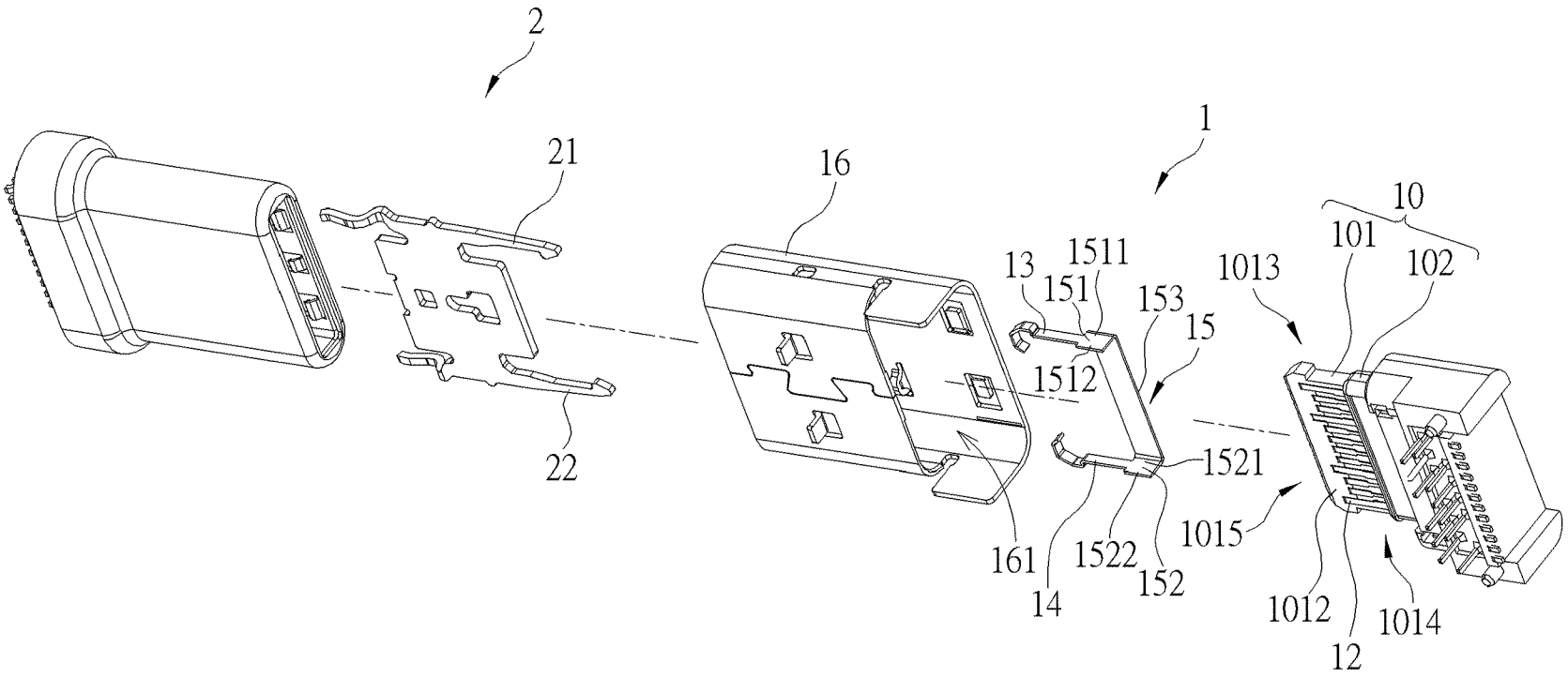

Please refer to FIG. 1 to FIG. 3. FIG. 1 is a schematic diagram of an electrical receptacle connector 1 and a corresponding electrical plug connector 2 according to a first embodiment of the present invention. FIG. 2 and FIG. 3 are exploded diagrams of the electrical receptacle connector 1 and the corresponding electrical plug connector 2 at different views according to the first embodiment of the present invention. As shown in FIG. 1 to FIG. 3, the electrical receptacle connector 1 is disposed on an electronic device, such as a desktop computer, a laptop computer or a mobile phone, to mate with the electrical plug connector 2 for battery charge or signal transmission of the electronic device. The electrical receptacle connector 1 includes an insulator 10, a first contact set 11, a second contact set 12, a first plate member 13, a second plate member 14, a U-shaped shielding structure 15 and a receptacle shell 16. An accommodating space 161 is formed inside the receptacle shell 16. The insulator 10 is disposed inside the accommodating space 161. The insulator 10 includes a tongue 101 and a base 102 connected to the tongue 101. The first contact set 11 is disposed inside the insulator 10 and exposed out of a first side 1011 of the tongue 101. The second contact set 12 is disposed inside the insulator 10 and exposed out of a second side 1012 of the tongue 101 opposite to the first side 1011 of the tongue 101. The U-shaped shielding structure 15 is disposed on the base 102, and two distal end portions of the U-shaped shielding structure 15 away from each other are embedded into the base 102. That is, the U-shaped shielding structure 15 is partially exposed out of the base 102. The first plate member 13 and the second plate member 14 extend from the two distal end portions of the U-shaped shielding structure 15 along two sides of the tongue 101 and toward a front end 1015 of the tongue 101.

Figure 4:
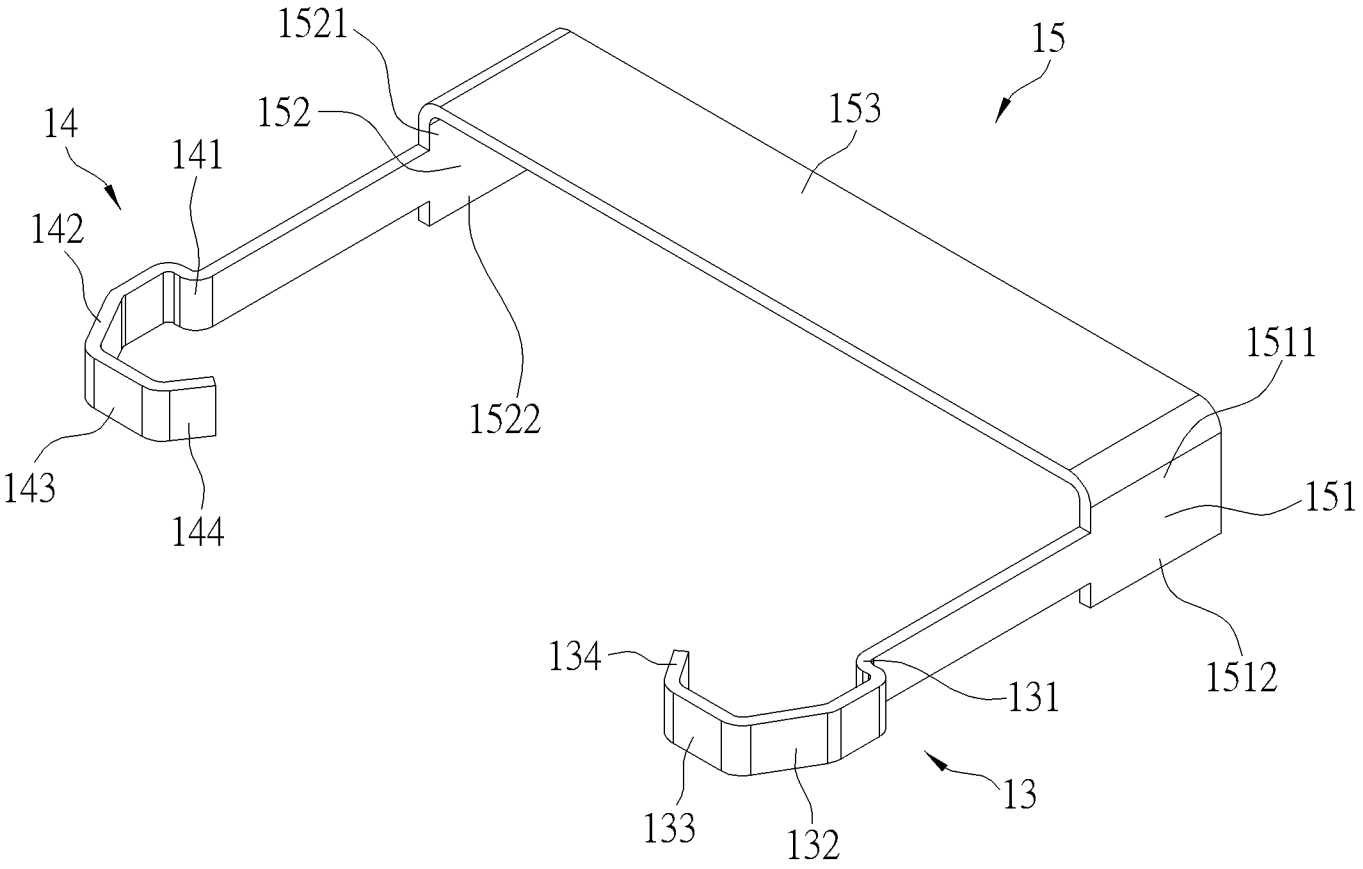
FIG. 4 is a diagram of a first plate member, a second plate member and a U-shaped shielding structure according to the first embodiment of the present invention.
Figure 5:
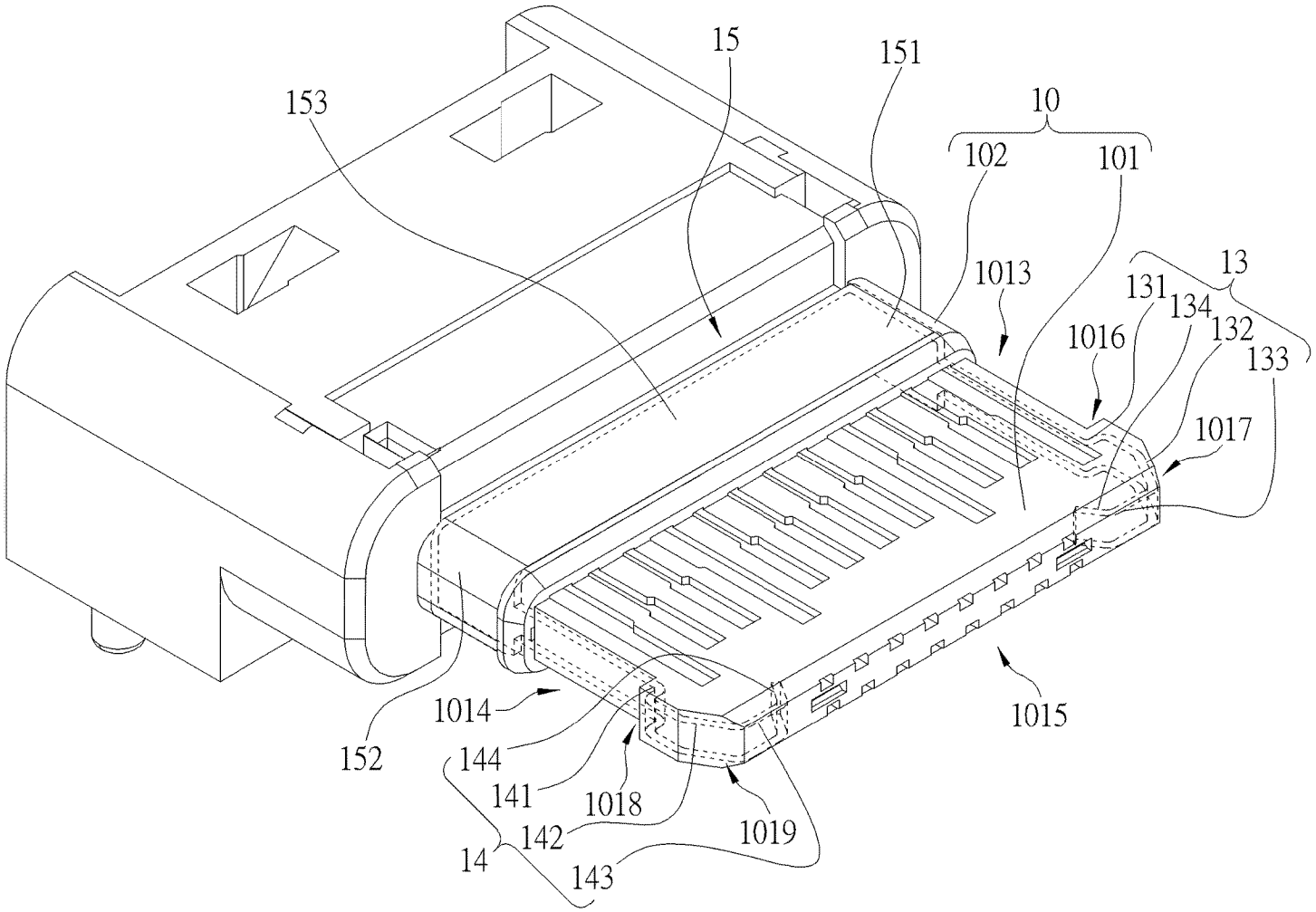
FIG. 5 is a diagram of the first plate member, the second plate member, the U-shaped shielding structure and an insulator according to the first embodiment of the present invention.

Specifically, please refer to FIG. 2 to FIG. 5. FIG. 4 is a diagram of the first plate member 13, the second plate member 14 and a U-shaped shielding structure 15 according to the first embodiment of the present invention. FIG. 5 is a diagram of the first plate member 13, the second plate member 14, the U-shaped shielding structure 15 and the insulator 10 according to the first embodiment of the present invention. As shown in FIG. 2 to FIG. 5, in this embodiment, the U-shaped shielding structure 15 includes a first member 151, a second member 152 and a third member 153. The first member 151 and the second member 152 are opposite to each other. The third member 153 is connected to a first end 1511 of the first member 151 and a third end 1521 of the second member 152. A second end 1512 of the first member 151 away from the first end 1511 of the first member 151 is separated from a fourth end 1522 of the second member 152 away from the third end 1521 of the second member 152. The third member 153 is exposed out of the base 102. The first member 151 and the second member 152 are embedded into the base 102. The first plate member 13 extends from the first member 151 of the U-shaped shielding structure 15 along a third side 1013 of the tongue 101 adjacent to the first side 1011 and the second side 1012 of the tongue 101 and toward the front end 1015 of the tongue 101. The second plate member 14 extends from the second member 152 of the U-shaped shielding structure 15 along a fourth side 1014 of the tongue 101 opposite to the third side 1013 of the tongue 101 and toward the front end 1015 of the tongue 101. In other words, the first plate member 13 and the second plate member 14 are embedded into the tongue 101 and extend from the two end portions of the U-shaped shielding structure 15 along the two opposite sides, i.e., the third side 1013 and the fourth side 1014, of the tongue 101. Furthermore, an end of the first plate member 13 adjacent to the front end 1015 of the tongue 101 is separated from an end of the second plate member 14 adjacent to the front end 1015 of the tongue 101. The first plate member 13, the second plate member 14 and the U-shaped shielding structure 15 can be integrally formed and made of metal material.

Furthermore, in order to increase insertion and withdrawal forces of the electrical receptacle connector 1 and the electrical plug connector 2 for ensuring connection of the electrical receptacle connector 1 and the electrical plug connector 2, as shown in FIG. 2 to FIG. 5, in this embodiment, a first engaging portion 1016 and a first guiding portion 1017 are formed on the third side 1013 of the tongue 101. The first engaging portion 1016 is for engaging with a first engaging arm 21 of the electrical plug connector 2 when the electrical plug connector 2 is inserted into the electrical receptacle connector 1. The first guiding portion 1017 is for guiding the first engaging arm 21 to engage with the first engaging portion 1016 when the electrical plug connector 2 is inserted into the electrical receptacle connector 1. A second engaging portion 1018 and a second guiding portion 1019 are formed on the fourth side 1014 of the tongue 101. The second engaging portion 1018 is for engaging with a second engaging arm 22 of the electrical plug connector 2 when the electrical plug connector 2 is inserted into the electrical receptacle connector 1. The second guiding portion 1019 is for guiding the second engaging arm 22 to engage with the second engaging portion 1018 when the electrical plug connector 2 is inserted into the electrical receptacle connector 1. That is, the first guiding portion 1017 and the second guiding portion 1019 guide the first engaging arm 21 and the second engaging arm 22 to engage with the first engaging portion 1016 and the second engaging portion 1018 respectively, when the electrical plug connector 2 is inserted into the electrical receptacle connector 1.

Besides, the first plate member 13 includes a first step structure 131, a first inclined structure 132, a first extending structure 133 and a first bending structure 134. The first step structure 131 is connected to the first member 151 of the U-shaped shielding structure 15. The first inclined structure 132 extends from an end of the first step structure 131 away from the U-shaped shielding structure 15 and toward the front end 1015 of the tongue 101. The first extending structure 133 extends from an end of the first inclined structure 132 away from the first step structure 131 along the front end 1015 of the tongue 101 and toward the fourth side 1014 of the tongue 101. The first bending structure 134 extends from an end of the first extending structure 133 away from the first inclined structure and toward an inner side of the tongue 101. Furthermore, as shown in FIG. 5, in this embodiment, the first step structure 131, the first inclined structure 132 and the first extending structure 133 are located inside the first engaging portion 1016, the first guiding portion 1017 and the front end 1015 of the tongue 101 respectively, and the shapes of the first step structure 131, the first inclined structure 132 and the first extending structure 133 are corresponding to the shapes of the first engaging portion 1016, the first guiding portion 1017 and the front end 1015 of the tongue 101 respectively, which reinforces overall structural strength of the tongue 101. However, it is not limited thereto. In another embodiment, the first step structure 131, the first inclined structure 132 and the first extending structure 133 of the first plate member 13 also can be located outside the first engaging portion 1016, the first guiding portion 1017 and the front end 1015 of the tongue 101 respectively.

Similarly, the second plate member 14 includes a second step structure 141, a second inclined structure 142, a second extending structure 143 and a second bending structure 144. The second step structure 141 is connected to the second member 152 of the U-shaped shielding structure 15. The second inclined structure 142 extends from an end of the second step structure 141 away from the U-shaped shielding structure 15 and toward the front end 1015 of the tongue 101. The second extending structure 143 extends from an end of the second inclined structure 142 away from the second step structure 141 along the front end 1015 of the tongue 101 and toward the third side 1013 of the tongue 101. The second bending structure 144 extends from an end of the second extending structure 143 away from the second inclined structure 142 and toward the inner side of the tongue 101. The first bending structure 134 of the first plate member 13 is separated from the second bending structure 144 of the second plate member 14. Furthermore, as shown in FIG. 5, in this embodiment, the second step structure 141, the second inclined structure 142 and the second extending structure 143 are located inside the second engaging portion 1018, the second guiding portion 1019 and the front end 1015 of the tongue 101 respectively, and the shapes of the second step structure 141, the second inclined structure 142 and the second extending structure 143 are corresponding to the shapes of the second engaging portion 1018, the second guiding portion 1019 and the front end 1015 of the tongue 101 respectively, which reinforces overall structural strength of the tongue 101. However, it is not limited thereto. In another embodiment, the second step structure 141, the second inclined structure 142 and the second extending structure 143 of the second plate member 14 also can be located outside the second engaging portion 1018, the second guiding portion 1019 and the front end 1015 of the tongue 101 respectively.

Figure 6:
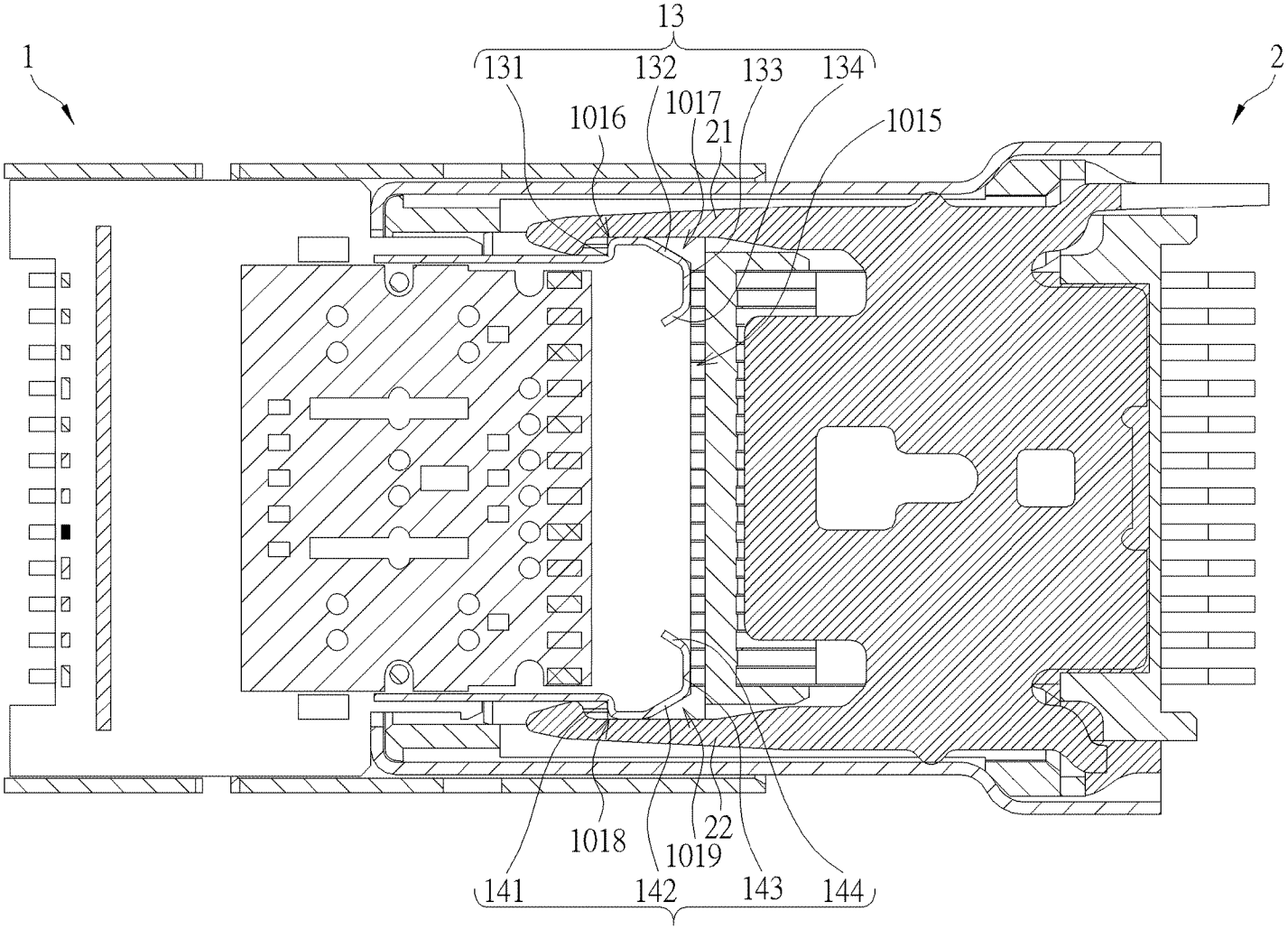
FIG. 6 is a diagram of the electrical receptacle connector and the corresponding electrical plug connector mated with each other according to the first embodiment of the present invention.

Please refer to FIG. 6. FIG. 6 is a diagram of the electrical receptacle connector 1 and the corresponding electrical plug connector 2 mated with each other according to the first embodiment of the present invention. When the electrical plug connector 2 is inserted into or withdrawn from the electrical receptacle connector 1, the first engaging arm 21 of the electrical plug connector 2 can contact with the front end 1015, the first guiding portion 1017 and the first engaging portion 1016 of the tongue 101 of the electrical receptacle connector 1, and the second engaging arm 22 of the electrical plug connector 2 can contact with the front end 1015, the second guiding portion 1019 and the second engaging portion 1018 of the tongue 101 of the electrical receptacle connector 1. Therefore, the first extending structure 133, the first inclined structure 132 and the first step structure 131 located inside the front end 1015, the first guiding portion 1017 and the first engaging portion 1016 of the tongue 101 and the second extending structure 143, the second inclined structure 142 and the second step structure 141 located inside the front end 1015, the second guiding portion 1019 and the second engaging portion 1018 of the tongue 101 can effectively reinforce the overall structural strength of the tongue 101 for preventing damage or deformation of the tongue 101 due to frequent contact of the tongue 101 with the first engaging arm 21 and the second engaging arm 22.

Figure 7:
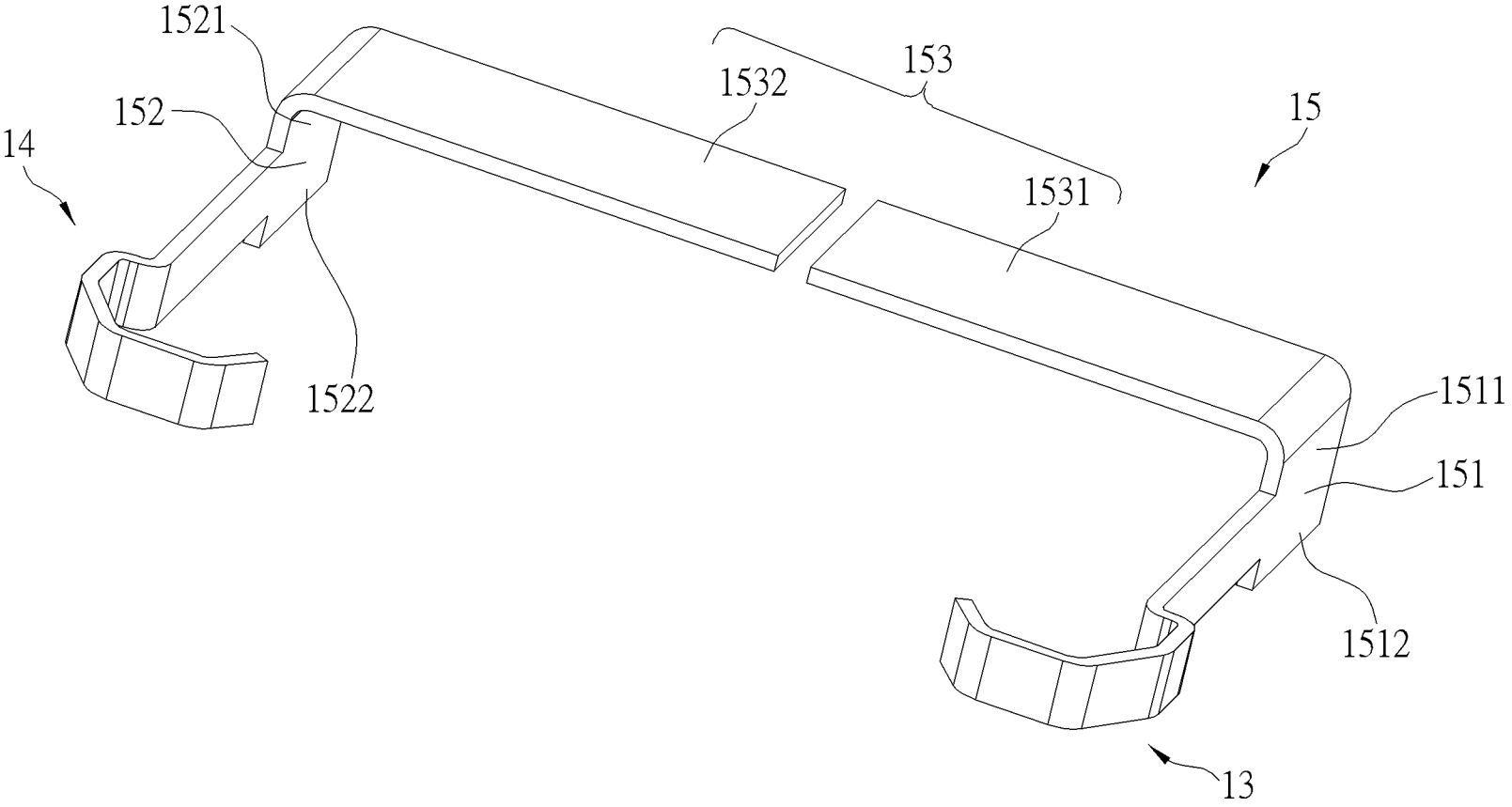
FIG. 7 is a diagram of a first plate member, a second plate member and a U-shaped shielding structure according to a second embodiment of the present invention.

However, the structures of the first plate member 13, the second plate member 14 and the U-shaped shielding structure 15 of the present invention are not limited to the aforementioned embodiment. For example, please refer to FIG. 7. FIG. 7 is a diagram of the first plate member 13, the second plate member 14 and the U-shaped shielding structure 15 according to a second embodiment of the present invention. As shown in FIG. 7, different from the aforementioned embodiment, the third member 153 of the U-shaped shielding structure 15 of the second embodiment includes a first segment 1531 and a second segment 1532. The first segment 1531 and the second segment 1532 are separated from each other. The first segment 1531 is connected to the first end 1511 of the first member 151. The second segment 1532 is connected to the third end 1521 of the second member 152. The first plate member 13 is connected to the first member 151. The second plate member 14 is connected to the second member 152. In other words, in this embodiment, the first member 151 of the U-shaped shielding structure 15 and the first segment 1531 of the third member 153 are integrally formed in an L-shaped structure, and the second member 152 of the U-shaped shielding structure 15 and the second segment 1532 of the third member 153 are integrally formed in another L-shaped structure and separated from the L-shaped structure formed by the first member 151 of the U-shaped shielding structure 15 and the first segment 1531 of the third member 153.

In contrast to the prior art, the present invention utilizes the first plate member and the second plate member extending from the U-shaped shielding structure for reinforcing overall structural strength of the tongue, which prevents damage or deformation of the tongue during frequent insertion and withdrawal of the electrical connector. Therefore, the electrical connector has a longer service life to reduce maintenance cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrical receptacle connector comprising:

an insulator comprising a tongue and a base connected to the tongue;

a first contact set disposed inside the insulator and exposed out of a first side of the tongue;

a second contact set disposed inside the insulator and exposed out of a second side of the tongue opposite to the first side of the tongue;

a U-shaped shielding structure disposed on the base and at least partially exposed out of the base, a portion of the U-shaped shielding structure being located at a side of the first contact set away from the second contact set;

a first plate member extending from an end portion of the U-shaped shielding structure along a third side of the tongue adjacent to the first side and the second side of the tongue and toward a front end of the tongue, and the first plate member comprising a first step structure; and a second plate member extending from another end portion of the U-shaped shielding structure away from the end portion of the U-shaped shielding structure along a fourth side of the tongue opposite to the third side of the tongue and toward the front end of the tongue, and the second plate member comprising a second step structure;

wherein an end of the first plate member adjacent to the front end of the tongue is separated from an end of the second plate member adjacent to the front end of the tongue.

2. The electrical receptacle connector of claim 1, wherein the U-shaped shielding structure comprises a first member, a second member and a third member, the first member and the second member are opposite to each other, the third member is connected to a first end of the first member and a third end of the second member, a second end of the first member away from the first end of the first member is separated from a fourth end of the second member away from the third end of the second member, the first plate member extends from the first member of the U-shaped shielding structure along the third side of the tongue and toward the front end of the tongue, and the second plate member extends from the second member of the U-shaped shielding structure along the fourth side of the tongue and toward the front end of the tongue.

3. The electrical receptacle connector of claim 1, wherein the U-shaped shielding structure comprises a first member, a second member and a third member, the first member and the second member are opposite to each other, the third member comprises a first segment and a second segment separated from the first segment, the first segment is connected to a first end of the first member, the second segment is connected to a third end of the second member, a second end of the first member away from the first end of the first member is separated from a fourth end of the second member away from the third end of the second member, the first plate member extends from the first member of the U-shaped shielding structure along the third side of the tongue and toward the front end of the tongue, and the second plate member extends from the second member of the U-shaped shielding structure along the fourth side of the tongue and toward the front end of the tongue.

4. The electrical receptacle connector of claim 1, wherein the first plate member further comprises a first inclined structure extending from an end of the first step structure away from the U-shaped shielding structure and toward the front end of the tongue.

5. The electrical receptacle connector of claim 4, wherein the first plate member further comprises a first extending structure extending from an end of the first inclined structure away from the first step structure along the front end of the tongue and toward the fourth side of the tongue opposite to the third side of the tongue.

6. The electrical receptacle connector of claim 5, wherein the first plate member further comprises a first bending structure extending from an end of the first extending structure away from the first inclined structure and toward an inner side of the tongue.

7. The electrical receptacle connector of claim 1, wherein the second plate member further comprises a second inclined structure extending from an end of the second step structure away from the U-shaped shielding structure and toward the front end of the tongue.

8. The electrical receptacle connector of claim 7, wherein the second plate member further comprises a second extending structure extending from an end of the second inclined structure away from the second step structure along the front end of the tongue and toward the third side of the tongue.

9. The electrical receptacle connector of claim 8, wherein the second plate member further comprises a second bending structure extending from an end of the second extending structure away from the second inclined structure and toward an inner side of the tongue.

* * * * *